US009331373B2

(12) United States Patent
Hirota et al.

(10) Patent No.: US 9,331,373 B2
(45) Date of Patent: May 3, 2016

(54) DIRECTIONAL COUPLER

(71) Applicant: Mitsubishi Electric Corporation, Tokyo (JP)

(72) Inventors: Akimichi Hirota, Tokyo (JP); Tetsu Owada, Tokyo (JP); Kazuhiro Iyomasa, Tokyo (JP); Shinsuke Watanabe, Tokyo (JP); Kazuya Yamamoto, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 31 days.

(21) Appl. No.: 14/224,829

(22) Filed: Mar. 25, 2014

(65) Prior Publication Data

US 2014/0292440 A1 Oct. 2, 2014

(30) Foreign Application Priority Data

Mar. 27, 2013 (JP) ..... 2013-066143

(51) Int. Cl.
*H01P 5/18* (2006.01)
*H01P 3/08* (2006.01)

(52) U.S. Cl.
CPC ..... *H01P 5/187* (2013.01)

(58) Field of Classification Search
CPC ..... H01P 5/18; H01P 3/08
USPC ..... 333/109, 112, 116
See application file for complete search history.

(56) References Cited

U.S. PATENT DOCUMENTS 3,768,042 A * 10/1973 Friend et al. ..... 333/116
4,737,740 A * 4/1988 Millican et al. ..... 333/116

FOREIGN PATENT DOCUMENTS

JP 3169820 B2 5/2001

OTHER PUBLICATIONS

David M. Pozar, "Microwave Engineering—Second Edition" (pp. 384, John Wiley & Sons. Inc., published in 1998).

* cited by examiner

*Primary Examiner* — Dean Takaoka
(74) *Attorney, Agent, or Firm* — Studebaker & Brackett PC

(57) ABSTRACT

Disclosed is a directional coupler including a first hollow portion that is disposed in a first ground conductor and is arranged directly above a first signal conductor and a second signal conductor, and that is constructed of a discontinuous structure that has a function of delaying the phase and that is small with respect to the one-quarter wavelength of an operating frequency.

10 Claims, 11 Drawing Sheets

DIRECTIONAL COUPLER

BACKGROUND OF THE INVENTION

1. Field of the Invention

The present invention relates to a directional coupler used in a microwave band or the like.

2. Description of Related Art

A directional coupler is widely used in order to carry out monitoring of electric power. As a directional coupler, there is a directional coupler having a structure of broadside-coupling two lines (for example, refer to the following nonpatent reference 1). By broadside-coupling lines this way, a directional coupler can be implemented.

RELATED ART DOCUMENT

Nonpatent reference 1: David M. Pozar, "Microwave Engineering-Second Edition" (pp. 384, John Wiley & Sons. Inc., published in 1998)

However, the following problems arise in conventional technologies. In a case in which a directional coupler is constructed of a microstrip line or a triplate line, there is a case in which the reflection characteristic and the isolation quantity of the directional coupler are minimized and the coupled line impedance maximizing the coupling amount is lower than the terminal impedance connected to each terminal of the coupler because of constraints on manufacturing, such as a substrate thickness and a line width. A problem is that because when the coupled line impedance is lower than the terminal impedance, the passing phase at the time of an even mode operation leads against that at the time of an odd mode operation, a phase difference occurs between the passing phase at the time of the even mode operation and that at the time of the odd mode operation, and hence the directivity degrades.

SUMMARY OF THE INVENTION

The present invention is made in order to solve the above-mentioned problems, and it is therefore an object of the present invention to provide a directional coupler that can provide good directivity even when its coupled line impedance is lower than a terminal impedance because of constraints on manufacturing.

In accordance with the present invention, there is provided a directional coupler including: a first signal conductor; a second signal conductor that is arranged on a plane different from that on which the first signal conductor is arranged, and that is arranged in parallel with the first signal conductor; a ground conductor that is isolated from the first signal conductor and the second signal conductor, and that is arranged in a direction which is identical with respect to the first signal conductor and the second signal conductor; and a reactive element that is disposed in the ground conductor and is arranged directly below the first signal conductor and the second signal conductor, and that is comprised of a discontinuous structure that has a function of delaying a phase and that is small with respect to the one-quarter wavelength of an operating frequency.

The directional coupler in accordance with the present invention includes the reactive element that is disposed in the ground conductor and is arranged directly below the first signal conductor and the second signal conductor, and that is comprised of a discontinuous structure that has a function of delaying the phase and that is small with respect to the one-quarter wavelength of the operating frequency. Therefore, even when the coupled line impedance is lower than the terminal impedance, the reactive element disposed directly below the first signal conductor and the second signal conductor makes it possible to make the passing phase at the time of an even mode operation match that at the time of an odd mode operation because a plane of symmetry between the first signal conductor and the second signal conductor serves as an electric wall at the time of the odd mode operation and hence the passing phases do not vary without being affected by the influence of the reactive element, while the phase is delayed while being affected by the influence of the reactive element at the time of the even mode operation as compared with a case in which the reactive element is not formed. Therefore, there is provided an advantage of being able to improve the directivity of the directional coupler.

Further objects and advantages of the present invention will be apparent from the following description of the preferred embodiments of the invention as illustrated in the accompanying drawings.

DETAILED DESCRIPTION OF THE PREFERRED EMBODIMENTS

Embodiment 1

Figure 1:
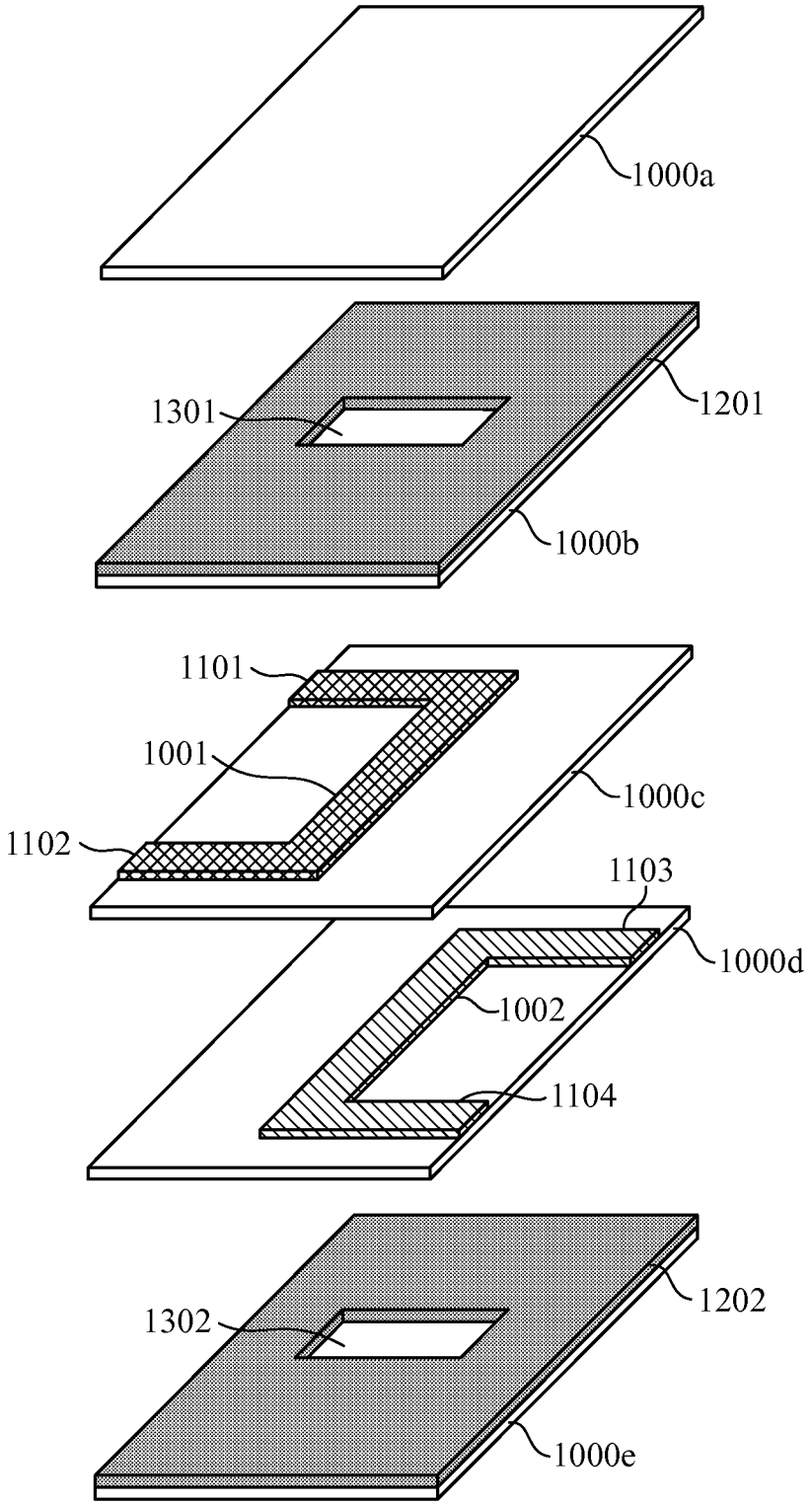
FIG. 1 is an exploded perspective view showing a directional coupler in accordance with Embodiment 1 of the present invention.

Hereafter, the preferred embodiments of a directional coupler in accordance with the present invention will be explained with reference to the drawings. In each of the views, the same reference numerals refer to the same elements or like elements.

Figure 2:
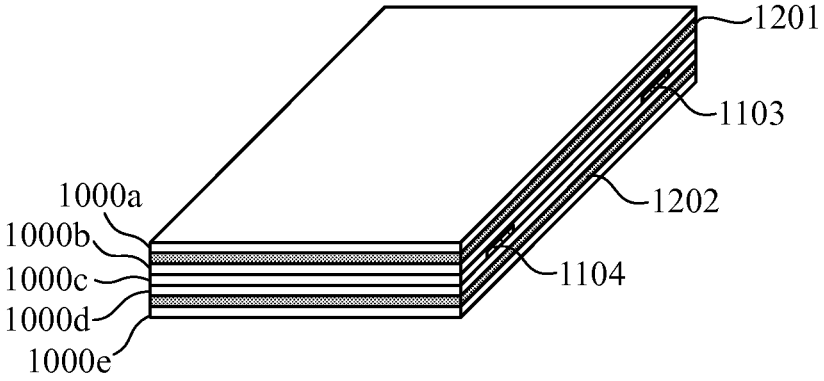
FIG. 2 is a perspective view showing a directional coupler in accordance with Embodiment 1 of the present invention.

FIG. 1 is an exploded perspective view showing a directional coupler in accordance with Embodiment 1, and FIG. 2 is a perspective view showing the directional coupler in accordance with Embodiment 1. In FIGS. 1 and 2, reference character strings 1000*a* to 1000*e* denote dielectric substrates, a reference numeral 1001 denotes a first signal conductor disposed on a surface of the dielectric substrate 1000*c*, a reference numeral 1002 denotes a second signal conductor disposed on a surface of the dielectric substrate 1000*d*. A reference numeral 1101 denotes a first input output terminal disposed in the first signal conductor 1001, a reference numeral 1102 denotes a second input output terminal disposed in the first signal conductor 1001. A reference numeral 1103 denotes a third input output terminal disposed in the second signal conductor 1002, and a reference numeral 1104 denotes a fourth input output terminal disposed in the second signal conductor 1002.

A reference numeral 1201 denotes a first ground conductor disposed on a surface of the dielectric substrate 1000*b*, and a reference numeral 1202 denotes a second ground conductor disposed on a surface of the dielectric substrate 1000*e*. A reference numeral 1301 denotes a first hollow portion in which a part of the first ground conductor 1201 is removed, and a reference numeral 1302 denotes a second hollow portion in which a part of the second ground conductor 1202 is removed. The length of each side of the first and second hollow portions 1301 and 1302 is sufficiently smaller than one fourth of a free space wavelength at an operating frequency. For example, the length of each side of the first and second hollow portions is 1/10 or less of the free space wavelength.

Figure 3:
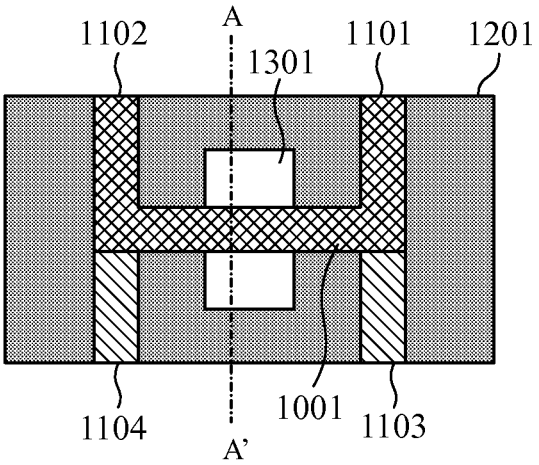
FIG. 3 is a top perspective view showing the directional coupler in accordance with Embodiment 1 of the present invention.
Figure 4:
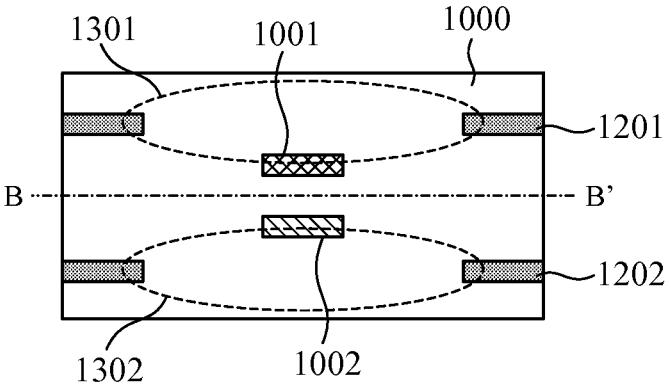
FIG. 4 is a cross-sectional view showing a cross section A-A' of FIG. 3.

FIG. 3 is a perspective diagram showing the directional coupler in accordance with Embodiment 1, and FIG. 4 is a cross-sectional view showing a cross section A-A' of FIG. 3. Referring to FIGS. 1 to 4, the first signal conductor 1001 and the second signal conductor 1002 are arranged in such a way that they can be seen overlapping each other with respect to a vertical direction, and they construct a broadside coupling portion.

Figure 5:
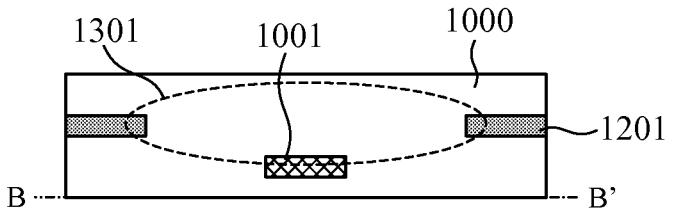
FIG. 5 is a cross-sectional view showing a cross section at the time of an even/odd mode operation in the directional coupler in accordance with Embodiment 1 of the present invention.

Because the direction coupler in accordance with this Embodiment 1 is symmetrical with respect to a cross section B-B' in FIG. 4, an even/odd mode analysis can be applied. A cross-sectional view in a case in which the cross section B-B' shown in FIG. 4 is made to serve as a magnetic wall/electric wall, i.e., at the time of an even/odd mode operation is shown in FIG. 5. The cross section B-B' shown in FIG. 5 serves as a magnetic wall at the time of an even mode operation, and serves as an electric wall at the time of an odd mode operation.

Figure 6:
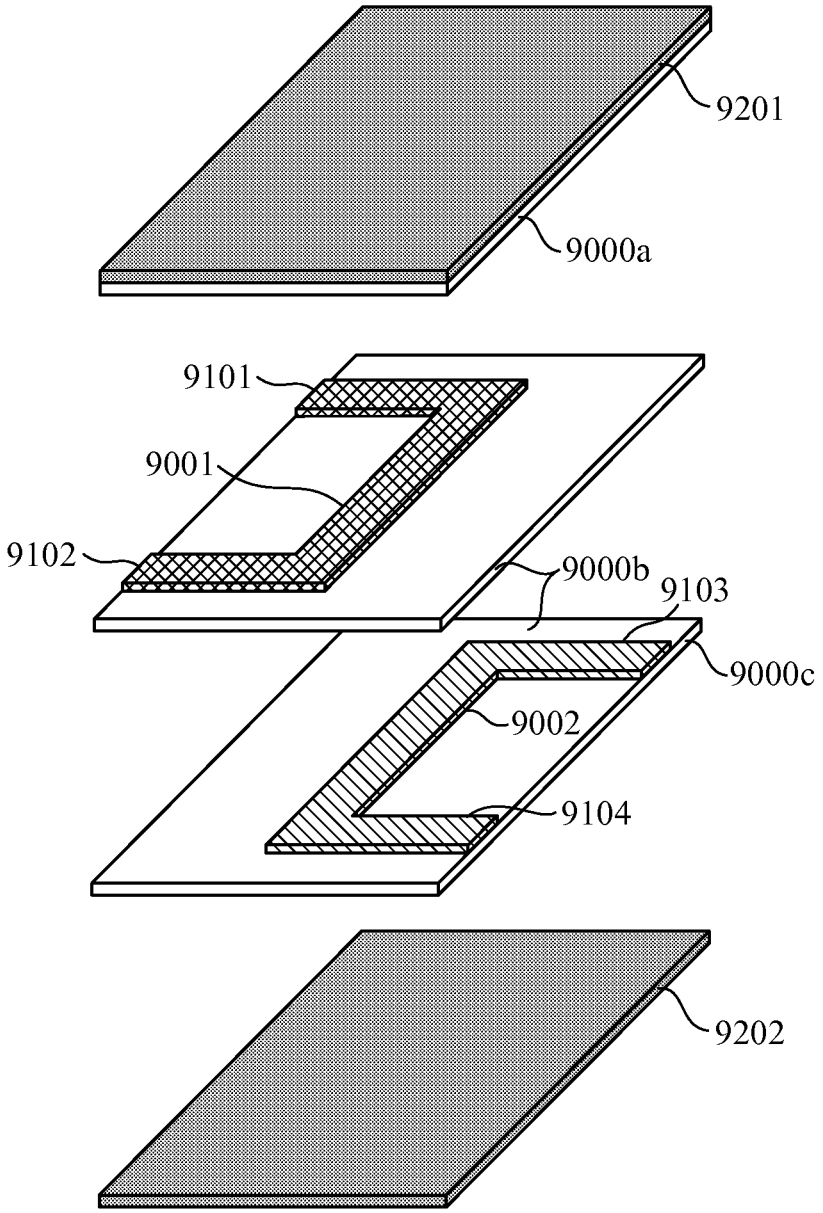
FIG. 6 is an exploded perspective view showing a conventional directional coupler.
Figure 7:
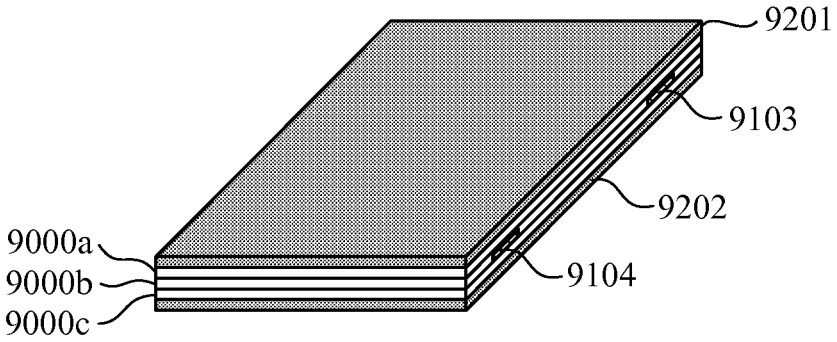
FIG. 7 is a perspective view showing the conventional directional coupler.

FIG. 6 is an exploded perspective view showing a conventional directional coupler. FIG. 7 is a perspective view showing the conventional directional coupler. In FIGS. 6 and 7, reference character strings 9000*a* to 9000*e* denote dielectric substrates, a reference numeral 9001 denotes a first signal conductor disposed on a surface of the dielectric substrate 9000*b*, a reference numeral 9002 denotes a second signal conductor disposed on a surface of the dielectric substrate 9000*c*. A reference numeral 9101 denotes a first input output terminal disposed in the first signal conductor 9001, a reference numeral 9102 denotes a second input output terminal disposed in the first signal conductor 9001. A reference numeral 9103 denotes a third input output terminal disposed in the second signal conductor 9002, and a reference numeral 9104 denotes a fourth input output terminal disposed in the second signal conductor 9002. A reference numeral 9201 denotes a first ground conductor disposed on a surface of the dielectric substrate 9000*a*, and a reference numeral 9202 denotes a second ground conductor.

Figure 8:
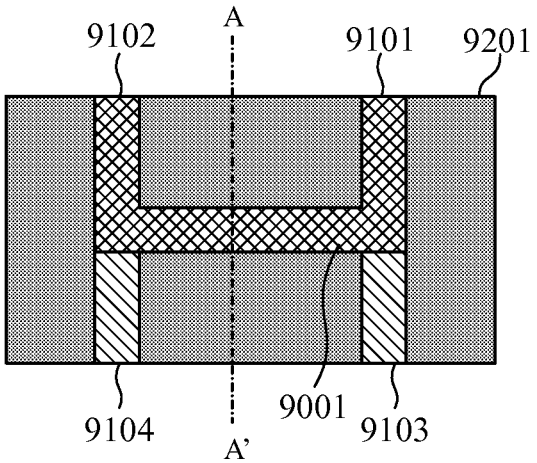
FIG. 8 is a top perspective view showing the conventional directional coupler.
Figure 9:
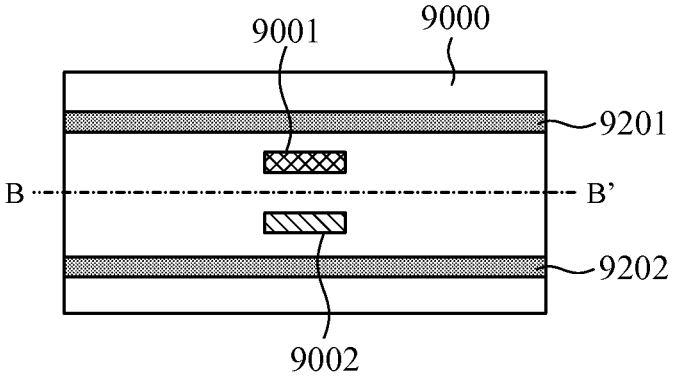
FIG. 9 is a cross-sectional view showing a cross section A-A' of FIG. 8.

FIG. 8 is a perspective diagram showing the conventional directional coupler, and FIG. 9 is a cross-sectional view showing a cross section A-A' of FIG. 8. Referring to FIGS. 6 to 9, the first signal conductor 9001 and the second signal conductor 9002 are arranged in such a way that they can be seen overlapping each other with respect to a vertical direction, and they construct a broadside coupling portion.

Figure 10:
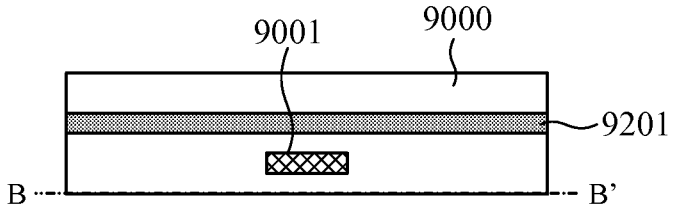
FIG. 10 is a cross-sectional view showing a cross section at the time of an even/odd mode operation in the conventional directional coupler.

Because the conventional direction coupler is symmetrical with respect to a cross section B-B' shown in FIG. 9, an even/odd mode analysis can be applied. A cross-sectional view in a case in which the cross section B-B' shown in FIG. 9 is made to serve as a magnetic wall/electric wall, i.e., at the time of an even/odd mode operation is shown in FIG. 10. The cross section B-B' shown in FIG. 10 serves as a magnetic wall at the time of an even mode operation, and serves as an electric wall at the time of an odd mode operation.

When the impedance of the line in the broadside coupling portion at the time of the even mode operation in which the cross section B-B' serves as a magnetic wall is expressed by $Z'_e$ and the impedance of the line in the broadside coupling portion at the time of the odd mode operation in which the cross section B-B' serves as an electric wall is expressed by $Z'_o$, the coupled line impedance Z' is given by the following equation (1).

$$Z'=\sqrt{Z'_eZ'_o} \quad (1)$$

Further, when the reflection characteristic at the time of the even mode operation is expressed by $S_{11e}$ and the pass characteristic at the time of the even mode operation is expressed by $S_{21e}$, and the reflection characteristic at the time of the odd mode operation is expressed by $S_{11o}$ and the pass characteristic at the time of the odd mode operation is expressed by $S_{21o}$, the reflection characteristic S11, the pass characteristic S21, the coupling characteristic S31, and the isolation characteristic S41 of the directional coupler are given by the following equations (2) to (5) respectively.

$$S11=(S_{11e}+S_{11o})/2 \quad (2)$$

$$S21=(S_{21e}+S_{21o})/2 \quad (3)$$

$$S31=(S_{11e}-S_{11o})/2 \quad (4)$$

$$S41=(S_{21e}-S_{21o})/2 \quad (5)$$

Further, the directivity D of the directional coupler is calculated according to the following equation (6), and the larger value this directivity has, the better directivity the directional coupler has.

$$D=20\times\log_{10}(|S31|)-20\times\log_{10}(|S41|) \quad (6)$$

By designing the broadside coupling portion in such a way that the coupled line impedance Z' expressed by the equation (1) becomes equal to the terminal impedance $Z_o$ of each of the first through fourth input output terminals 9101 to 9104, the reflection characteristic and the isolation quantity of the directional coupler can be minimized while the coupling amount can be maximized.

Figure 11:
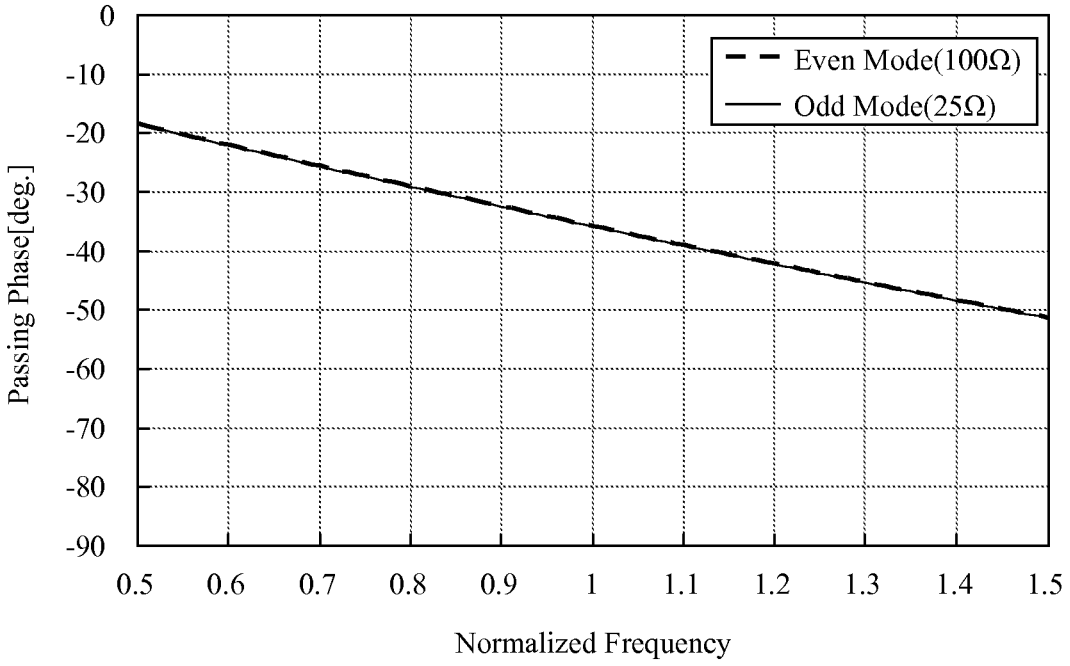
FIG. 11 is a characteristic diagram showing a passing phase with respect to a normalized frequency at the time of an even (100Ω) mode operation and an odd (25Ω) mode operation.

FIG. 11 shows examples of the calculation of the phase passing from the first input output terminal 9101 to the second input output terminals 9102 when the impedance $Z'_e$ of the line at the time of the even mode operation is 100Ω, the coupled line length is 30 degrees, and the terminal impedance of each of the first and second input output terminals 9101 and 9102 is 50Ω, and the phase passing from the first input output terminal 9101 to the second input output terminals 9102 when the impedance $Z'_o$ of the line at the time of the odd mode operation is 25Ω, the coupled line length is 30 degrees, and the terminal impedance of each of the first and second input output terminals 9101 and 9102 is 50Ω.

In this case, because it can be seen from the equation (1) that the coupled line impedance is 50Ω and is equal to the terminal impedance of each input output terminal, the passing phase at the time of the even mode operation matches that at the time of the odd mode operation, and the passing amount at the time of the even mode operation similarly matches that at the time of the odd mode operation, as shown in FIG. 11.

Although the isolation characteristic can be determined according to the equation (5), the isolation characteristic of the directional coupling coupler using the coupled line satisfying these conditions is 0 and the directivity of the directional coupler is infinite because the amplitudes of $S_{21e}$ and $S_{21o}$ are equal to each other and their passing phases are also equal to each other.

However, there is a case in which the coupled line impedance cannot be made to be equal to the terminal impedance because of constraints on manufacturing, such as a substrate thickness and a line width. It is assumed hereafter that the line width cannot be thinned because of constraints on manufacturing, and the impedance $Z'_o$ at the time of the even mode operation and the impedance $Z'_o$ at the time of the odd mode operation are 80Ω and 20Ω respectively. At this time, the coupled line impedance is 40Ω according to the equation (1). On the other hand, because the impedance of each of circuits connected before and after the directional coupler is typically 50Ω, the terminal impedance of the directional coupler at this time is 50Ω.

Figure 12:
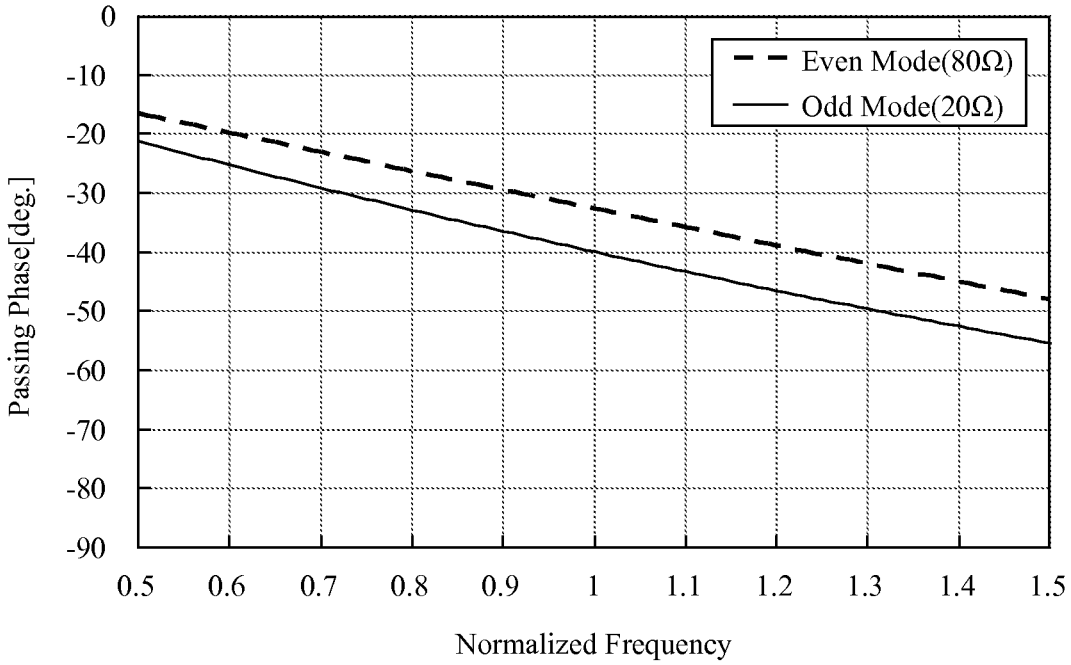
FIG. 12 is a characteristic diagram showing a passing phase with respect to a normalized frequency at the time of an even (80Ω) mode operation and an odd (20Ω) mode operation.

An example of the calculation of the phase passing from the first input output terminals 9101 to the second input output terminals 9102 is shown in FIG. 12. Although the amplitude of the passage $S_{21e}$ at the time of the even mode operation is nearly equal to that of the passage $S_{21o}$ at the time of the odd mode operation because the coupled line length is short, the passing phase at the time of the odd mode operation lags behind that at the time of the even mode operation and the passing phase difference becomes large, as shown in FIG. 12.

From this fact and the equation (5), in the conventional directional coupler, when the coupled line impedance becomes lower than the terminal impedance connected to each terminal of the coupler because of constraints on manufacturing, the passages ($S_{21e}$ and $S_{21o}$) at the times of the even and odd mode operations do not cancel each other, and hence the isolation quantity increases and the directivity of the directional coupler degrades. More specifically, a problem is that when the coupled line impedance becomes lower than the terminal impedance because of constraints on manufacturing or the like, the directivity of the directional coupler degrades.

Figure 13:
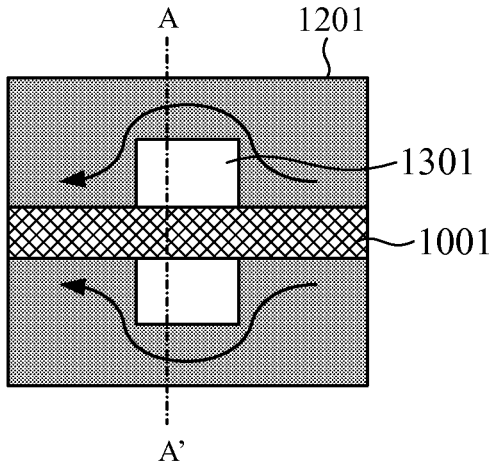
FIG. 13 is a top perspective view showing the time of an even mode operation in accordance with Embodiment 1 of the present invention.

In contrast, in the directional coupler in accordance with this Embodiment 1, the first hollow portion 1301 that operates as a reactive element is disposed in the first ground conductor 1201 and the second hollow portion 1302 which operates as a reactive element is disposed in the second ground conductor 1202. A reactive element represents a structure having an effect of delaying the passing phase of a signal passing through the reactive element, as compared with a typical straight line in which no reactive element exists. In accordance with this Embodiment 1, such reactive elements are implemented by a first hollow portion 1301 partially disposed in the first ground conductor 1201 and constructed of a discontinuous structure that has a function of delaying the phase and is sufficiently small with respect to the one-quarter wavelength of an operating frequency and a second hollow portion 1302 partially disposed in the second ground conductor 1202 and constructed of a discontinuous structure that has a function of delaying the phase and is sufficiently small with respect to the one-quarter wavelength of the operating frequency. A path through which a current flows in the first ground conductor 1201 disposed above the first signal conductor 1001 at the time of the even mode operation of the directional coupler in accordance with Embodiment 1 is shown in FIG. 13. Further, an electric field distribution in a cross section A-A' shown in FIG. 13 is shown in FIG. 14.

Figure 14:
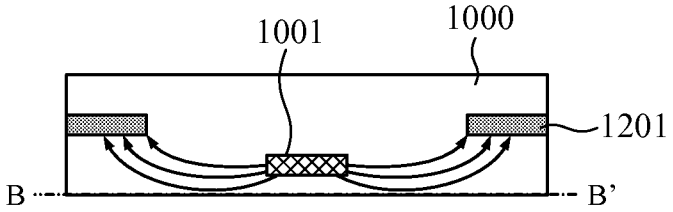
FIG. 14 is a cross-sectional view showing an electric field distribution in a cross section A-A' of FIG. 13.

Because a cross section B-B' shown in FIG. 14 serves as a magnetic wall, electric lines of force occurring from the signal line are terminated at the first ground conductor 1201. Therefore, as shown in FIG. 13, the current flowing through the first ground conductor 1201 flows in such a way as to bypass the first hollow portion 1301. In contrast, in the conventional directional coupler in which no first hollow portion 1301 is disposed, the current flowing through the first ground conductor 9201 does not bypass. More specifically, in the directional coupler in accordance with this Embodiment 1, the passing phase at the time of the even mode operation can be delayed as compared with that at the time of the even mode operation of the conventional directional coupler. More specifically, the first hollow portion 1301 operates as a reactive element.

Figure 15:
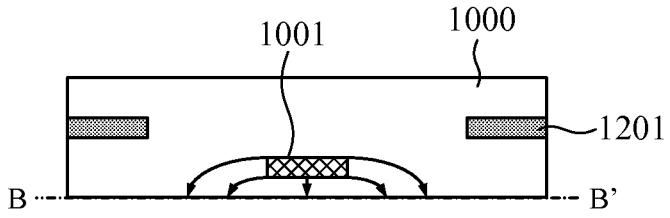
FIG. 15 is a cross-sectional view showing an electric field distribution in a cross section A-A' at the time of an odd mode operation in which it is assumed that a cross section B-B' of FIG. 5 is an electric wall.

An electric field distribution in the cross section A-A' at the time of the odd mode operation in which it is assumed that the cross section B-B' shown in FIG. 5 serves as an electric wall is shown in FIG. 15. It is determined that at the time of the odd mode operation in the directional coupler in accordance with Embodiment 1, the gap between the first signal conductor 1001 and the cross section B-B' which serves as an electric wall is smaller than the gap between the first signal conductor 1001 and the first ground conductor 1201, as shown in FIG. 15. Electric lines of force occurring from the first signal conductor 1001 exist only between the first signal conductor 1001 and the electric wall of the cross section B-B'. Therefore, a return current of the current flowing through the first signal conductor 1001 flows through the cross section B-B' which serves as the electric wall regardless of the presence or absence of the first hollow portion 1301 disposed in the first ground conductor 1201. More specifically, the passing phase at the time of the odd mode operation in the directional coupler in accordance with Embodiment 1 becomes equal to that at the time of the odd mode operation in the conventional directional coupler without the first hollow portion 1106.

As a result, while the passing phase at the time of the even mode operation is delayed by the first hollow portion 1301, there is no change in the passing phase at the time of the odd mode operation. Therefore, by determining the size of the first hollow portion 1301 in such a way that the passing phase at the time of the even mode operation matches that at the time of the odd mode operation even when the coupled line impedance is lower than the terminal impedance, the passages at the times of the even and odd mode operations can be made to cancel each other, and hence the isolation quantity can be decreased. Therefore, better directivity can be provided.

Figure 16:
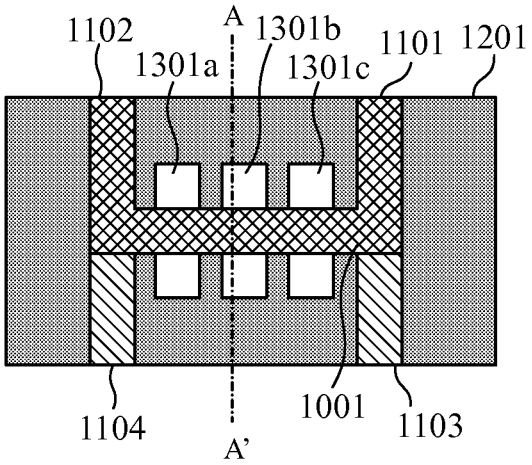
FIG. 16 is a top perspective view showing another directional coupler in accordance with Embodiment 1 of the present invention.

Further, although only one hollow portion is disposed as each of the first and second hollow portions 1301 and 1302 in the directional coupler in accordance with Embodiment 1, this embodiment is not limited to this example. As shown in FIG. 16, two or more first hollow portions 1301 can be arranged. FIG. 16 is a top perspective view showing another directional coupler in accordance with Embodiment 1. In the figure, reference character strings 1301*a*, 1301*b*, and 1301*c* denote the first hollow portions formed in the first ground conductor 1201. Further, although not shown in FIG. 16, second hollow portions are disposed at three positions in the second ground conductor 1202 which are symmetrical to those in the first hollow portions 1301*a*, 1301*b*, and 1301*c* respectively. Because this structure makes it possible to further delay the passing phase at the time of the even mode operation as compared with the case in which only one hollow is disposed as each hollow portion, the passing phase at the time of the even mode operation can be easily made to match that at the time of the odd mode operation, and hence the design can be facilitated.

Although the first hollow portion 1301 in accordance with Embodiment 1 is shaped like a rectangle, this embodiment is not limited to this example. The shape of the first hollow portion 1301 should just be made to match that of the second hollow portion 1302.

Figure 17:
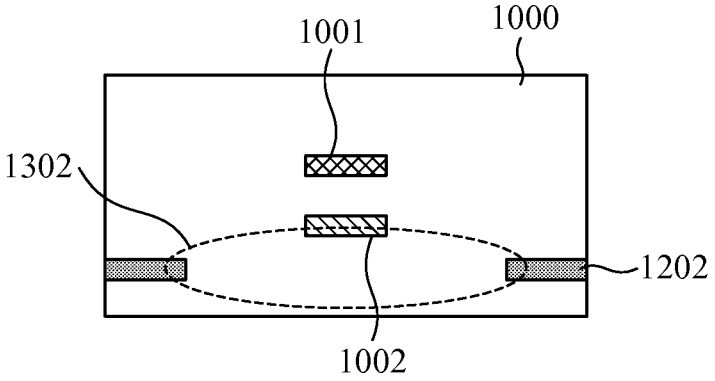
FIG. 17 is a cross-sectional view showing a cross section A-A' of FIG. 3 of the other directional coupler in accordance with Embodiment 1 of the present invention.

Further, although the first ground conductor 1201 and the second ground conductor 1202 are arranged in Embodiment 1, this embodiment is not limited to this example. The same advantages are provided as long as at least one of the ground conductors is arranged as shown in FIG. 17. In the case in which the number of ground conductors is reduced to one, a cost reduction can be accomplished because the number of layers can be reduced.

As mentioned above, the directional coupler in accordance with this Embodiment 1 includes the first hollow portion 1301 that is disposed in the first ground conductor 1201 and is arranged directly above the first signal conductor 1001 and the second signal conductor 1002, and that is constructed of a discontinuous structure that has a function of delaying the phase and that is small with respect to the one-quarter wavelength of an operating frequency, and the second hollow portion 1302 that is disposed in the second ground conductor 1202 and is arranged directly below the first signal conductor 1001 and the second signal conductor 1002, and that is constructed of a discontinuous structure that has a function of delaying the phase and that is small with respect to the one-quarter wavelength of the operating frequency. Therefore, even when the coupled line impedance is lower than the terminal impedance, the first hollow portion 1301 disposed directly above the first signal conductor 1001 and the second hollow portion 1302 disposed directly below the second signal conductor 1002 make it possible to make the passing phase at the time of the even mode operation match that at the time of the odd mode operation because the plane of symmetry between the first signal conductor 1001 and the second signal conductor 1002 serves as an electric wall at the time of the odd mode operation and hence the passing phases do not vary without being affected by the influence of the first and second hollow portions 1301 and 1302, while the phase is delayed while being affected by the influence of the first and second hollow portions 1301 and 1302 at the time of the even mode operation as compared with a case in which the first and second hollow portions 1301 and 1302 are not formed. Therefore, the directivity of the directional coupler can be improved.

In accordance with this Embodiment 1, the first reactive element is constructed of the first hollow portion 1301 in which a part of the first ground conductor 1201 is removed, and the second reactive element is constructed of the second hollow portion 1302 in which a part of the second ground conductor 1202 is removed. Therefore, the first hollow portion 1301 in which a part of the first ground conductor 1201 is removed and the second hollow portion 1302 in which a part of the second ground conductor 1202 can easily construct the reactive elements.

In accordance with this Embodiment 1, two or more hollows are disposed as the first and second hollow portions 1301 and 1302. Therefore, the passing phases can be easily made to match each other, and a directional coupler with good directivity can be designed easily.

Embodiment 2

Figure 18:
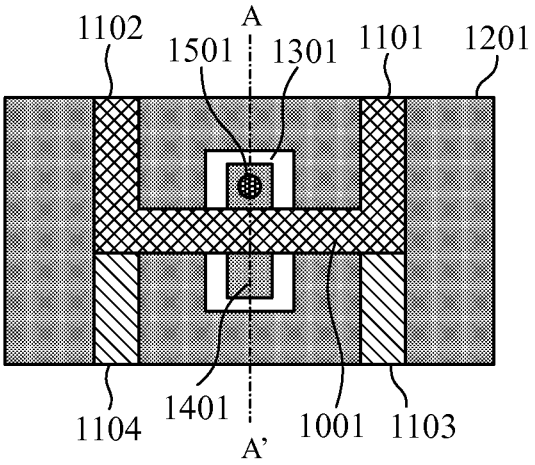
FIG. 18 is a top perspective view showing a directional coupler in accordance with Embodiment 2 of the present invention.
Figure 19:
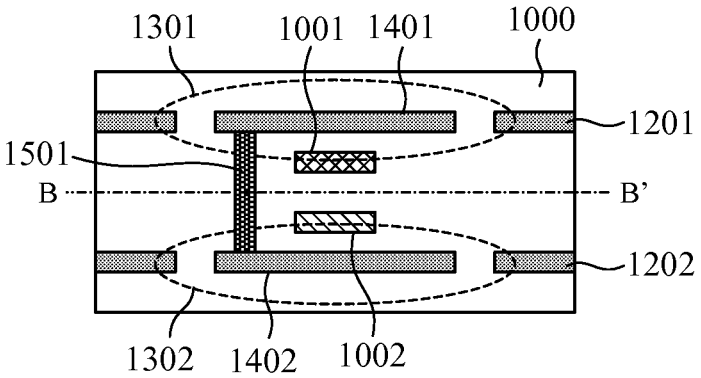
FIG. 19 is a cross-sectional view showing a cross section A-A' of FIG. 18.

FIG. 18 is a perspective diagram showing a directional coupler in accordance with Embodiment 2. FIG. 19 is a cross-sectional view showing a cross section A-A' shown in FIG. 18. In FIGS. 18 and 19, a reference numeral 1000 denotes a dielectric substrate, a reference numeral 1001 denotes a first signal conductor disposed in the dielectric substrate 1000, and a reference numeral 1002 denotes a second signal conductor disposed in the dielectric substrate 1000. A reference numeral 1101 denotes a first input output terminal, a reference numeral 1102 denotes a second input output terminal, a reference numeral 1103 denotes a third input output terminal, and a reference numeral 1104 denotes a fourth input output terminal.

Further, a reference numeral 1401 denotes a first floating conductor disposed in a first hollow portion 1301, a reference numeral 1402 denotes a second floating conductor disposed in a second hollow portion 1302, and a reference numeral 1501 denotes a connecting conductor that connects between the first floating conductor 1401 and the second floating conductor 1402. The length of each side of the first and second hollow portions 1301 and 1302 is 1/10 or less of a free space wavelength at an operating frequency.

Figure 20:
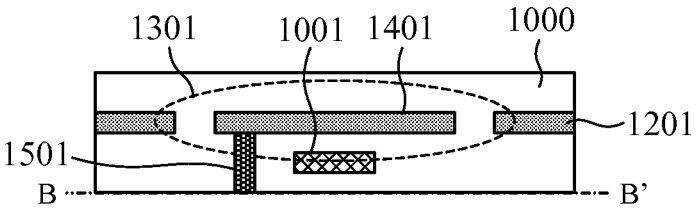
FIG. 20 is a cross-sectional view showing the time of an even/odd mode operation in which it is assumed that a cross section B-B' of FIG. 19 is a magnetic wall/electric wall.

Because the directional coupler in accordance with this Embodiment 2 is symmetrical with respect to a cross section B-B' shown in FIG. 19, an even/odd mode analysis can be applied. A cross-sectional view when the cross section B-B' shown in FIG. 19 serves as a magnetic wall/electric wall, that is, at the time of an even/odd mode operation is shown in FIG. 20. The cross section B-B' shown in FIG. 20 serves as a magnetic wall at the time of an even mode operation and serves as an electric wall at the time of an odd mode operation.

Figure 21:
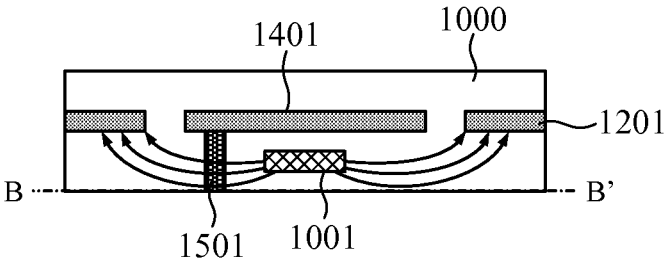
FIG. 21 is a cross-sectional view showing the time of an even mode operation in which it is assumed that the cross section B-B' of FIG. 19 is a magnetic wall.
Figure 22:
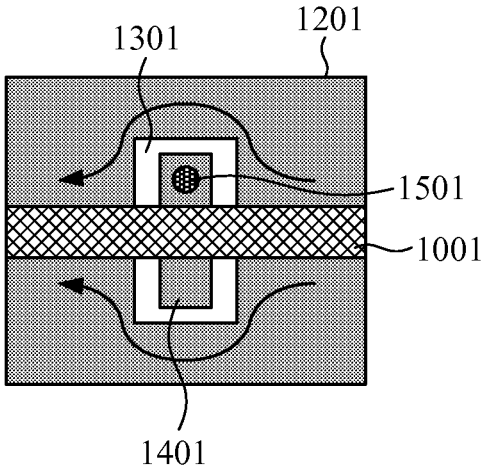
FIG. 22 is a top perspective view showing the time of an even mode operation in accordance with Embodiment 2 of the present invention.

At the time of the even mode operation, the cross section B-B' serves as a magnetic wall. More specifically, because the connecting conductor 1501 and the first floating conductor 1401 are connected to no conductors, no influence is exerted on an electric field propagating through the first signal conductor 1001. Therefore, an electric field distribution as shown in FIG. 21 is provided. Because the cross section B-B' serves as a magnetic wall as shown in FIG. 21, electric lines of force occurring from the signal line are terminated at the first ground conductor 1201. Therefore, as shown in FIG. 22, a current flowing through the first ground conductor 1201 flows in such away as to bypass the first hollow portion 1301. More specifically, in the directional coupler in accordance with this Embodiment 2, the passing phase at the time of the even mode operation can be delayed as compared with that at the time of the even mode operation of a conventional directional coupler, like in the case of the directional coupler in accordance with above-mentioned Embodiment 1.

Figure 23:
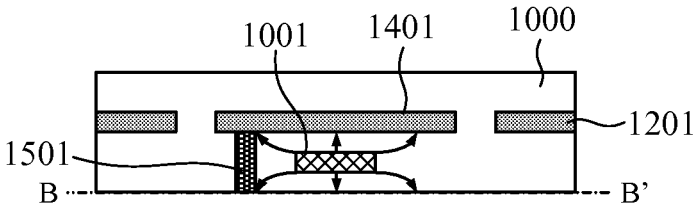
FIG. 23 is a cross-sectional view showing the time of an odd mode operation in which it is assumed that the cross section B-B' of FIG. 19 is an electric wall.
Figure 24:
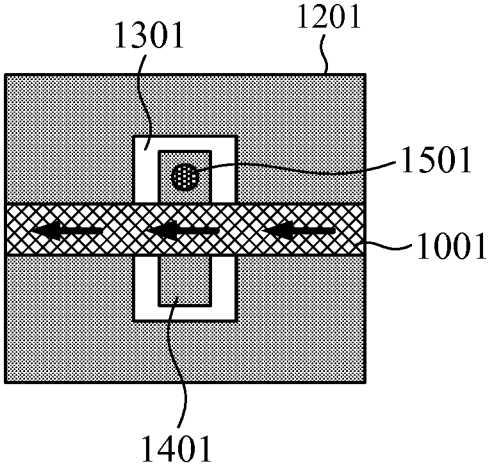
FIG. 24 is a top perspective view showing the time of an odd mode operation in accordance with Embodiment 2 of the present invention.

An electric field distribution at the time of the odd mode operation in which it is assumed that the cross section B-B' shown in FIG. 20 serves as an electric wall is shown in FIG. 23. Because the connecting conductor 1501 is connected to the electric wall at the time of the odd mode operation of the directional coupler in accordance with Embodiment 2, the first floating conductor 1401 and the connecting conductor 1501 operate as ground conductors. Therefore, electric lines of force occurring in the first signal conductor 1001 are terminated at the cross section B-B' and at the first floating conductor 1401. Therefore, a return current of the current flowing through the first signal conductor 1001 flows through the cross section B-B' which serves as an electric wall, and also through the first ground conductor 1201 and the first floating conductor 1401, as shown in FIG. 24. Therefore, the passing phase at the time of the odd mode operation in the directional coupler in accordance with Embodiment 2 becomes equal to that at the time of the odd mode operation in the conventional directional coupler.

As a result, while the passing phase at the time of the even mode operation is delayed, there is no change in the passing phase at the time of the odd mode operation. Therefore, by determining the sizes of the first hollow portion 1301 and the first floating conductor 1401 in such a way that the passing phase at the time of the even mode operation matches that at the time of the odd mode operation even when the coupled line impedance is lower than the terminal impedance, the passages at the times of the even and odd mode operations can be made to cancel each other, and hence the directivity of the directional coupler can be improved.

Figure 25:
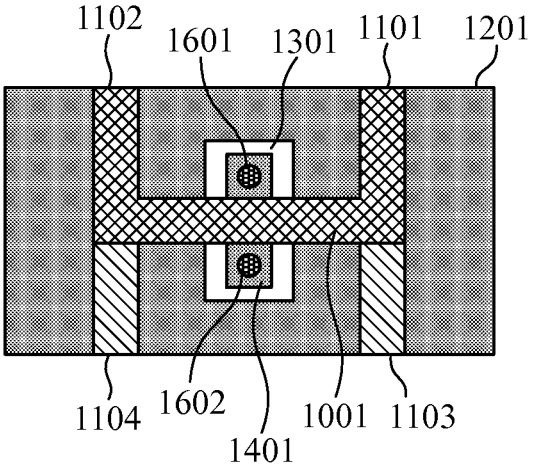
FIG. 25 is a top perspective view showing another directional coupler in accordance with Embodiment 2 of the present invention.

Although only one conductor is used as the connecting conductor 1501 in Embodiment 2, this embodiment is not limited to this example. As shown in FIG. 25, two or more connecting conductors can be used. FIG. 25 is a top perspective view showing another directional coupler in accordance with Embodiment 2. In the figure, a reference numeral 1601 denotes a first connecting conductor that connects between the first floating conductor 1401 and the second floating conductor 1402, and a reference numeral 1602 denotes a second connecting conductor that connects between the first floating conductor 1401 and the second floating conductor 1402. Because each of the first and second floating conductors 1401 and 1402 at the time of the odd mode operation is connected to an electric wall at two or more points thereof in the case in which the two or more connecting conductors are used, each of the first and second floating conductors operates as a ground conductor more ideally than that in the case in which only one connecting conductor is used, and hence the design can be facilitated.

Figure 26:
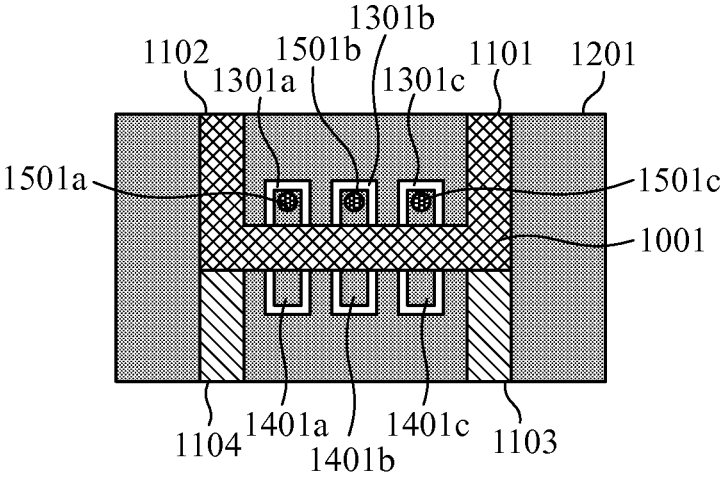
FIG. 26 is a top perspective view showing the other directional coupler in accordance with Embodiment 2 of the present invention.

Further, although only one hollow is used as each of the first and second hollow portions 1301 and 1302, only one conductor is used as each of the first and second floating conductors 1401 and 1402, and only one conductor is used as the connecting conductor 1501 in Embodiment 2, this embodiment is not limited to this example. As shown in FIG. 26, two or more hollows can be used as each of the first and second hollow portions, two or more conductors can be used as each of the first and second floating conductors, and two or more connecting conductors can be used. FIG. 26 is a top perspective view showing another directional coupler in accordance with Embodiment 2. In the figure, reference character strings 1301*a*, 1301*b*, and 1301*c* denote first hollow portions formed in the first ground conductor 1201. Reference character strings 1401*a*, 1401*b*, and 1401*c* denote first floating conductors disposed in the first hollow portions 1301*a*, 1301*b*, and 1301*c* respectively. In addition, although not shown in FIG. 26, second hollow portions are disposed at three positions in the second ground conductor 1202 which are symmetrical to those in the first hollow portions 1301*a*, 1301*b*, and 1301*c* respectively, and second floating conductors are disposed at three positions in the second ground conductor 1202 which are symmetrical to those in the first floating conductors 1401*a*, 1401*b*, and 1401*c* respectively. A reference character string 1501*c* denotes a first connecting conductor that connects between the first floating conductor 1401*c* and the second floating conductor symmetrical to the first floating conductor, a reference character string 1501*b* denotes a first connecting conductor that connects between the first floating conductor 1401*b* and the second floating conductor symmetrical to the first floating conductor, and a reference character string 1501*c* denotes a first connecting conductor that connects between the first floating conductor 1401*c* and the second floating conductor symmetrical to the first floating conductor. Because this structure makes it possible to further delay the passing phase at the time of the even mode operation as compared with the case in which only one hollow is disposed as each hollow portion, the passing phase at the time of the even mode operation can be easily made to match that at the time of the odd mode operation, and hence the design can be facilitated.

Figure 27:
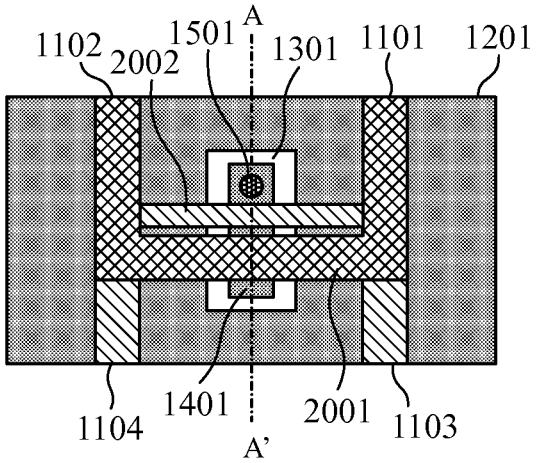
FIG. 27 is a top perspective view showing the other directional coupler in accordance with Embodiment 2 of the present invention.
Figure 28:
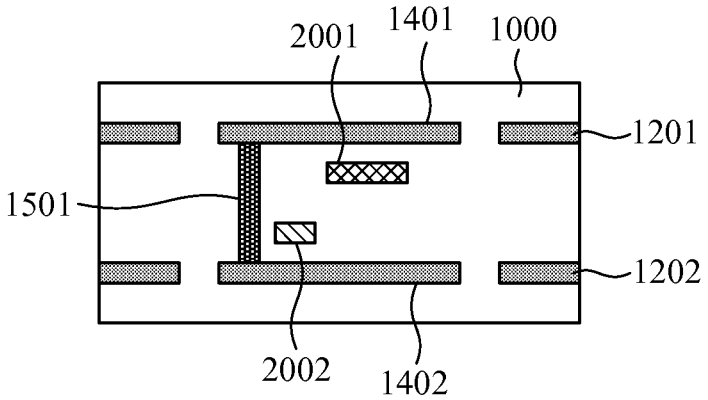
FIG. 28 is a cross-sectional view showing a cross section A-A' of FIG. 27.

Further, although in Embodiment 2 the first signal line 1001 and the second signal line 1002 are arranged in such a way that they have the same width and can be seen overlapping each other with respect to a vertical direction, this embodiment is not limited to this example. The first signal line and the second signal line can be arranged in such away that they have different widths and are out of alignment with each other with respect to a vertical direction, as shown in FIGS. 27 and 28. In this case, the same advantages can be provided. FIG. 27 is a top perspective view showing another directional coupler in accordance with Embodiment 2. FIG. 28 is a cross-sectional view taken on a cross section A-A' of FIG. 27. In the figure, a reference numeral 2001 denotes a first signal line and a reference numeral 2002 denotes a second signal line.

Figure 29:
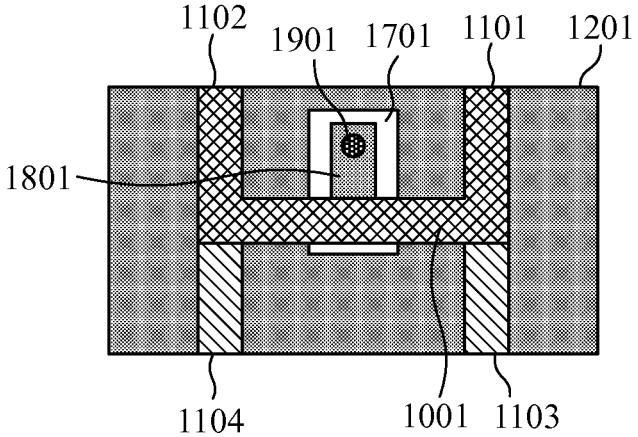
FIG. 29 is a top perspective view showing another directional coupler in accordance with Embodiment 2 of the present invention.

Further, although in Embodiment 2 the first hollow portion 1301 is formed in such a way that a central part of the first hollow portion 1301 is aligned with both a central part of the first signal line 1001 and a central part of the second signal line 1002, this embodiment is not limited to this example. As shown in FIG. 29, the first hollow portion can be formed in such a way that an end part of the first hollow portion is aligned with both the central part of the first signal line 1001 and the central part of the second signal line 1002. FIG. 29 is a top perspective view showing another directional coupler in accordance with Embodiment 2. In the figure, a reference numeral 1701 denotes a first hollow portion formed in the first ground conductor 1201 in such a way that an end portion thereof is aligned with the central part of the first signal conductor 1001. A reference numeral 1801 denotes a first floating conductor disposed in the first hollow portion 1701. In addition, although not shown in FIG. 29, a second hollow portion is disposed at a position in the second ground conductor 1202 which is symmetrical to that in the first hollow portion 1701, and a second floating conductor is disposed at a position in the second ground conductor 1202 which is symmetrical to that in the first floating conductor 1801. A reference numeral 1901 denotes a connecting conductor that connects between the first floating conductor 1801 and the second floating conductor which is symmetrical to the first floating conductor 1801.

As mentioned above, in accordance with this Embodiment 2, the first reactive element is comprised of the first floating conductor 1401 that is disposed in the first hollow portion 1301 in such a way as to be in non-contact with the first ground conductor 1201, in addition to the first hollow portion 1301, and the second reactive element is comprised of the second floating conductor 1402 that is disposed in the second hollow portion 1302 in such a way as to be in non-contact with the second ground conductor 1202, in addition to the second hollow portion 1302, and the first floating conductor 1401 and the second floating conductor 1402 are connected to each other via the connecting conductor 1501. Therefore, an adjustment of the sizes and shapes of the first floating conductor 1401 and the second floating conductor 1402, in addition to an adjustment of the first hollow portion 1301 and the second hollow portion 1302, can make the passing phases match each other and can easily design a directional coupler with good directivity. Further, the connecting conductor 1501 maintains the electric balance between the first floating conductor 1401 and the second floating conductor 1402, thereby providing better characteristics.

While the invention has been described in its preferred embodiments, it is to be understood that an arbitrary combination of two or more of the above-mentioned embodiments can be made, various changes can be made in an arbitrary component in accordance with any one of the above-mentioned embodiments, and an arbitrary component in accordance with any one of the above-mentioned embodiments can be omitted within the scope of the invention.

What is claimed is:

1. A directional coupler comprising:

a first signal conductor;

a second signal conductor that is arranged on a plane different from that on which said first signal conductor is arranged, and that is arranged in parallel with said first signal conductor;

a first ground conductor that is isolated from said first signal conductor and said second signal conductor, and that is arranged above said first signal conductor and said second signal conductor;

a second ground conductor that is isolated from said first signal conductor and said second signal conductor, and that is arranged below said first signal conductor and said second signal conductor;

a first reactive element that is disposed in said first ground conductor and is arranged directly above said first signal conductor and said second signal conductor, and that has a length smaller than a one-quarter wavelength of an operating frequency; and a second reactive element that is disposed in said second ground conductor and is arranged directly below said first signal conductor and said second signal conductor, and that has a length smaller than the one-quarter wavelength of the operating frequency, wherein said first reactive element is comprised of a first hollow portion formed by removing a part of said first ground conductor, and wherein said second reactive element is comprised of a second hollow portion formed by removing a part of said second ground conductor.

2. The directional coupler according to claim 1, wherein said second hollow portion is disposed at a position in said second ground conductor which is symmetrical to that of said first hollow portion in said first ground conductor.

3. The directional coupler according to claim 1, wherein said second hollow portion is disposed in said second ground conductor in such a way as to have the same shape as said first hollow portion of said first ground conductor.

4. The directional coupler according to claim 1, wherein said first reactive element is comprised of a first floating conductor that is disposed in said first hollow portion in such a way as to be in non-contact with said first ground conductor, in addition to said first hollow portion, and said second reactive element is comprised of a second floating conductor that is disposed in said second hollow portion in such a way as to be in non-contact with said second ground conductor, in addition to said second hollow portion, and wherein said first floating conductor and said second floating conductor are connected to each other via at least one connecting conductor.

5. The directional coupler according to claim 1, wherein at least two first reactive elements including said first reactive element are disposed and at least two second reactive elements including said second reactive element are disposed.

6. The directional coupler according to claim 2, wherein at least two first reactive elements including said first reactive element are disposed and at least two second reactive elements including said second reactive element are disposed.

7. The directional coupler according to claim 3, wherein at least two first reactive elements including said first reactive element are disposed and at least two second reactive elements including said second reactive element are disposed.

8. The directional coupler according to claim 4, wherein at least two first reactive elements including said first reactive element are disposed and at least two second reactive elements including said second reactive element are disposed.

9. A directional coupler comprising:

a first signal conductor;

a second signal conductor that is arranged on a plane different from that on which said first signal conductor is arranged, and that is arranged in parallel with said first signal conductor;

a ground conductor that is isolated from said first signal conductor and said second signal conductor, and that is arranged in a direction which is identical with respect to both said first signal conductor and said second signal conductor; and a reactive element that is disposed in said ground conductor and is arranged directly below said first signal conductor and said second signal conductor, and that has a length smaller than a one-quarter wavelength of an operating frequency, the reactive element being comprised of a hollow portion formed by removing a part of said ground conductor.

10. The directional coupler according to claim 9, wherein at least two reactive elements including said reactive element are disposed.

* * * * *